United States Patent [19]

Naum

[11] 4,250,823

[45] Feb. 17, 1981

[54] PRODUCT AND METHOD OF FORMING NETWORK FABRIC

[76] Inventor: Elena D. Naum, 1212 N. Graycroft Ave., Madison, Tenn. 37115

[21] Appl. No.: 57,829

[22] Filed: Jul. 16, 1979

[51] Int. Cl.[3] ..... D05B 97/00

[52] U.S. Cl. ..... 112/266.1; 112/121.24; 112/412

[58] Field of Search ..... 112/412, 402, 121.18, 112/121.24, 262.1, 263.1, 266.1; 428/37, 105, 114; 2/192

[56] References Cited

U.S. PATENT DOCUMENTS

| | | | |
|---|---|---|---|
| 1,233,259 | 7/1917 | Loeb | 112/266.1 |
| 1,236,984 | 8/1917 | Reiss | 2/192 |
| 1,936,434 | 11/1933 | Jumonville | 112/412 X |
| 2,053,959 | 9/1936 | Karle | 112/412 |
| 2,513,559 | 7/1950 | Greenberg | 112/412 X |
| 3,073,266 | 1/1963 | Guide | 112/121.18 |

FOREIGN PATENT DOCUMENTS

| | | | |
|---|---|---|---|
| 81893 | 8/1919 | Switzerland | 112/266.1 |

*Primary Examiner*—H. Hampton Hunter
*Attorney, Agent, or Firm*—Harrington A. Lackey

[57] ABSTRACT

A patterned network fabric and method of making the same, including a plurality of generally radially extending base strands of thread, preferably laid from a single base thread extending diametrically from one side of the fabric to the other where a loop is formed and the thread directed diametrically back through the center adjacent the first strand to form a second loop at the opposite side of the fabric, and the continuous laying of base thread diametrically and alternately to form circumferentially spaced radial strands having outer edge loops. A plurality of generally circumferential continuous threads are stitched concentrically about the center of the fabric and interlocked with the radial base strands to form the pattern fabric.

6 Claims, 5 Drawing Figures

PRODUCT AND METHOD OF FORMING NETWORK FABRIC

BACKGROUND OF THE INVENTION

This invention relates to a product and method for forming network fabric, and more particularly to a product and method for forming patterned network fabric.

Network fabrics, such as doilies, placemats, etc. are formed by various methods such as crocheting.

Examples of the stitching together of parallel base strands to form network fabric are disclosed in the following U.S. patents:

U.S. Pat. No. 1,281,273 Waite, Oct. 15, 1918
U.S. Pat. No. 1,936,434 Jumonville, Nov. 21, 1933
U.S. Pat. No. 2,053,959 Karle, Sept. 8, 1936

SUMMARY OF THE INVENTION

It is therefore an object of this invention to provide a special method of forming patterned network fabric, and the product resulting therefrom, by the arrangement of substantially radial strands of a base thread and the interlocking of the same in position by a plurality of substantially concentric stitched threads.

In the preferred form of the invention, a sewing frame, preferably made from readily detachable sections, has a central opening and a plurality of circumferentially spaced hooks or projections surrounding the central opening. With this sewing frame assembled, a single base thread, with one end tied to one of the hooks, is layed or strung diametrically through the center of the opening and looped about a diametrically opposite hook. The thread is returned diametrically through the center where it is looped about the second hook adjacent to the original hook to which the end of the base thread was tied. The base thread is alternately strung consecutively and diametrically through the center to consecutive adjacent hooks diametrically opposite each other, until the base thread has been looped about all of the hooks and forms generally radially extending strands of the base thread from the center position, with the outer ends of adjacent base strands forming outer loops.

Preferably, the sewing frame with its looped radial strands, is placed beneath the reciprocal needle of a conventional sewing machine and manually manipulated to form a plurality of generally circumferential stitch strands about the center of the fabric. Each concentric circumferential stitch thread interlocks with the radial strands to form a pattern having radial strands and a plurality of circumferential strands, with the outer ends of the radial strands forming loops.

Although such a method is generally carried out upon a circular frame having a central circular opening, nevertheless, the frame can have other shapes, such as a diamond shape. The process would be the same, including the laying of radial base strands and circumferential stitch strands, but the outer loops of the radial strands would be disposed in the general shape of the frame, such as a diamond shape.

Network fabrics formed in accordance with this method may be duplicated and sewn or stitched together to form larger pieces of network fabric.

The frames are preferably sectional, each section being provided with means for detachably connecting the sections together to form a rigid frame, yet the section can be quickly disassembled to facilitate removal of the completed network fabric from the hooks of the frame.

DESCRIPTION OF THE PREFERRED EMBODIMENTS

Figure 1:
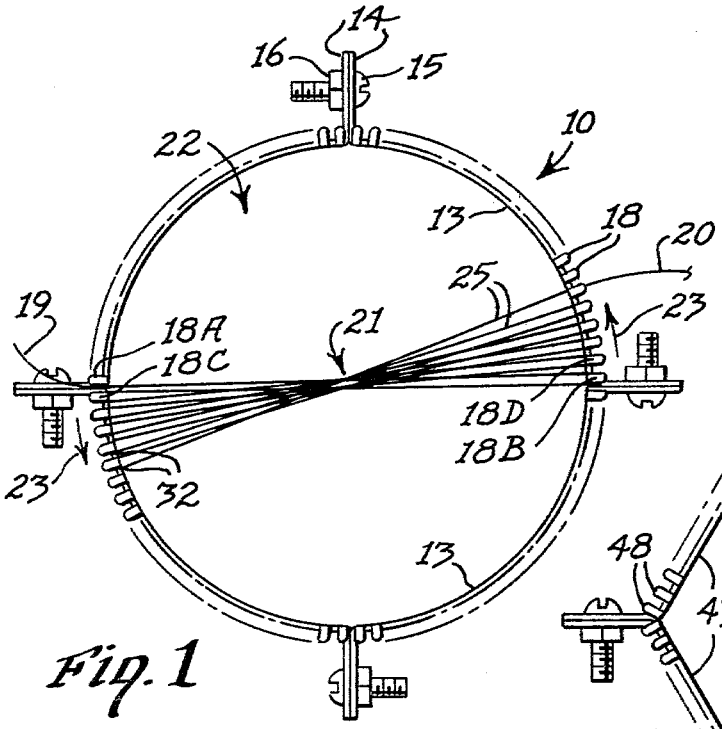
FIG. 1 is a top plan view of a circular sewing frame used in the method of carrying out this invention, and illustrating the initial steps of laying the radial strands of the base thread.
Figure 2:
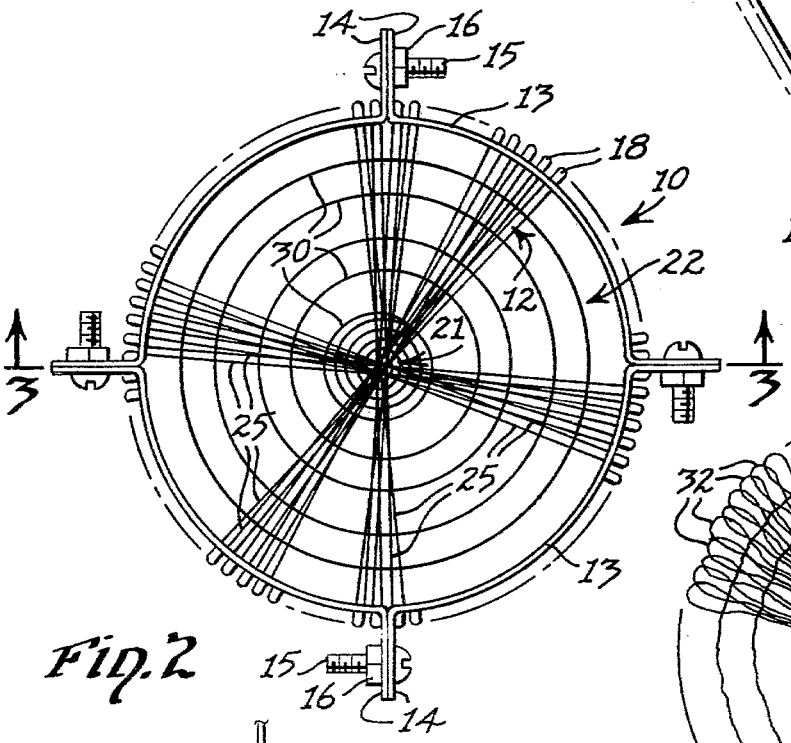
FIG. 2 is a view similar to FIG. 1, illustrating the completed patterned network fabric made in accordance with this method, disclosing only some of the radial base strands.
Figure 4:
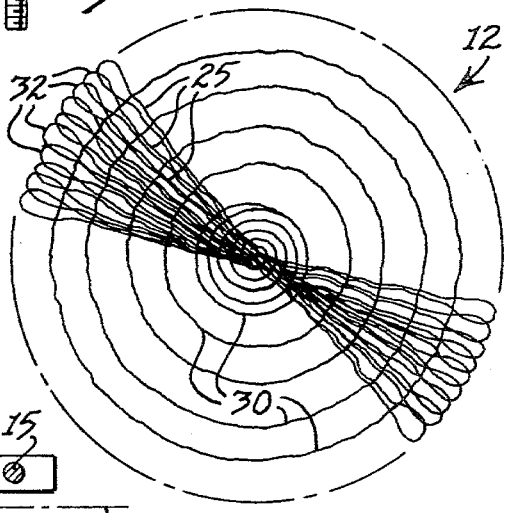
FIG. 4 is a top plan view of the completed fabric removed from the sewing frame, with only some of the radial strands illustrated.
Figure 3:
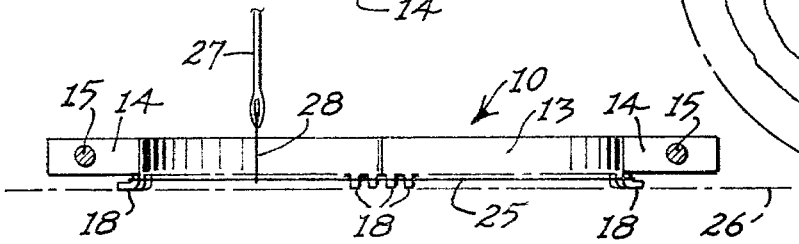
FIG. 3 is a section taken along the line 3—3 of FIG. 2, illustrating the sewing needle in position for stitching the circumferential stitch threads.

Referring now to the drawings in more detail, FIGS. 1-3 disclose one form of sewing frame 10 used for carrying out the method of forming or making a patterned network fabric 12, such as illustrated in FIG. 4.

The sewing frame 10 is disclosed as being circular and being divided into four quadrant sections 13, each section terminating in a pair of outward radial flanges 14. The adjacent radial flanges 14 of adjacent quadrant sections 13 are detachably secured together by a fastener member, such as a bolt 15 and nut 16.

Projecting radially outward from the bottom edge of each quadrant section 13 are a plurality of projections, hooks, or lugs 18.

In carrying out the method of forming a patterned network fabric, such as 12 in FIG. 4, the quadrant sections 13 are first assembled by securing the bolts 15 and nuts 16 to the adjacent flanges 14 in order to form the assembled circular sewing frame 10.

Sewing frame 10 is turned upside down, as illustrated in FIG. 1, and one end 19 of a base thread or yarn 20 is secured to one of the radially projecting hooks 18, as illustrated in FIG. 1. The free end 19 may be held by the finger in the position disclosed in FIG. 1 while the laying of the base thread 20 progresses, to prevent slipping of the base thread about the hooks 18.

The base thread 20 is first extended from the hook 18A across the opening in the sewing frame 10 through the center portion 21 of the opening 22 until that strand of the base thread 20 extends diametrically across the opening 22. The base thread 20 is then looped about the hook 18B diametrically across from the hook 18A, and the second strand of the base thread 20 is extended back across the central opening 22 through the central area 21 where it is looped about the hook 18C adjacent the original hook 18A. Again the base thread 20 is carried diametrically back across the opening 22 through the central area 21 to be looped about the next adjacent hook 18D on the opposite side of the frame 10. This threading back and forth across the center portion 21 of the central opening 22 and looping about consecutive hooks 18 continues as illustrated by the directional arrows 23 in FIG. 1. FIG. 1 illustrates the base thread 20 after it has been threaded about 6 times across the central opening 22 to loop about 6 diametrically opposed hooks 18. This laying of the base thread 20 continues consecutively and diametrically alternately until the entire frame 10 has been covered, and preferably all of the hooks 18 carry loops of the base yarn 20.

After the frame 10 has been covered with the base yarn 20 to form circumferentially spaced radially extending radial or base strands 25, the sewing frame 10 is turned rightside up and the bottom portion of the frame 10, including the hooks 18, is layed upon the flat surface or table 26 (FIG. 3) of a sewing machine including a vertically reciprocable sewing needle 27 carrying a stitch thread 28.

The sewing frame 10 is preferably manipulated by hand beneath the reciprocable needle 27 so that the needle 27 stitches the thread 28 in a substantially circular or circumferential path around the center portion 21 of the frame 10, to form the circumferential stitched threads 20, which cross and interlock with most, if not each, of the radial strands 25. As disclosed in FIG. 2, several concentric circumferential strands 30 have been stitched across the radial strands 25 to form the pattern illustrated in FIGS. 2 and 4. In both FIGS. 2 and 4, many of the radial strands 25 have been omitted for clarity. In the completed fabric 12, the adjacent radial strands 25 would continue 360° around the central area 21.

In order to remove the patterned fabric 12 from the frame 10, the nuts 16 are loosened and the bolts 15 removed to separate the quadrant sections 13. Then the loops 32 formed around the respective hooks 18 are readily removed from the hooks 18 to separate the completed fabric 12 from the frame 10. The completed fabric 12 will then appear as it does in FIG. 4 with the radial strands 25 completed consecutively circumferentially around the entire fabric.

It will be understood that varying numbers of the concentric strands 30 can be stitched to form varying patterns.

Figure 5:
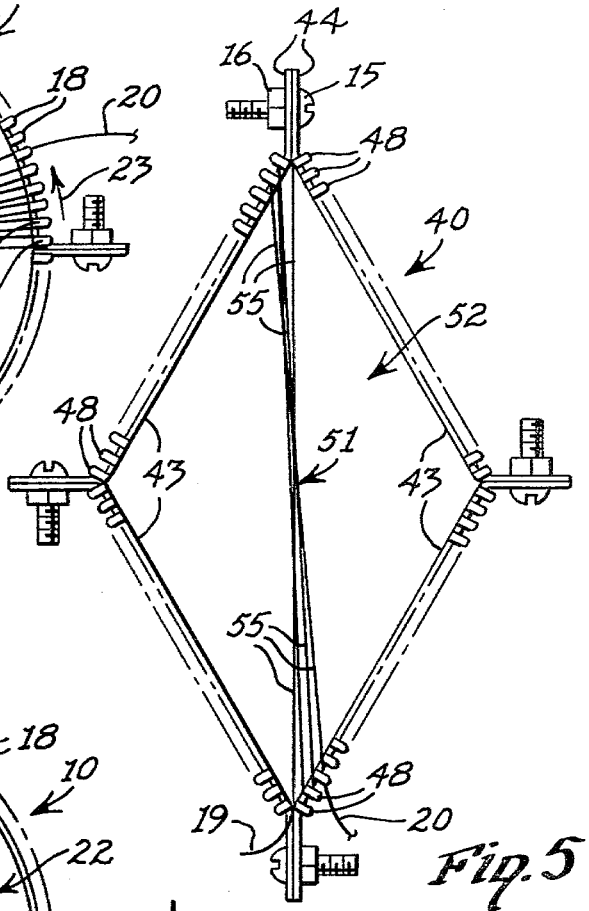
FIG. 5 is a top plan view of a modified diamond-shaped sewing frame in which only a few of the radial base strands have been laid.

FIG. 5 discloses a modified frame 40 having a diamond shape. The sewing frame 40 also is formed of 4 quadrant sections 43, each quadrant section 43 forming a straight side of the diamond shaped frame. The ends of the quandrant sections 43 terminate in attachment flanges 44 which are secured by bolts 15 and nuts 16, in the same manner as the flanges 14 of the frame 10 are secured. The method of making a fabric upon the frame 40 is the same as the method of making the fabric upon the frame 10. The base yarn 20 is threaded diagonally through the center area 51 of the diamond-shaped opening 52 alternately about diametrically opposed hooks 48 until the entire opening 52 is covered, and all of the hooks 48 carry consecutively formed loops of the base threads 20.

The frame 40 may be used beneath the sewing needle 27 in the same manner as the sewing frame 10. The fabric made on the sewing frame 40 will be substantially identical to the fabric 12 except that it will have an overall diamond-shape, but will still include radial strands 55 and circumferential strands, not shown, but identical to the circumferential strands 30. The fabric completed upon the frame 40 will be removed in the same manner as the fabric 12 is removed from the frame 10, that is by detaching the nuts 16 and bolts 15 from the flanges 44.

It will be understood that sewing frames of other configurations than the sewing frames 10 and 40 could be used for making various peripheral patterns for base fabrics made upon these respective frames. However, the method of carrying out the threading of the base thread 20 and the circumferential stitches 30 would remain the same.

It is also within the scope of this invention to stitch the circumferential threads 30 in other patterns than circular. For example, these stitch threads 30 could be stitched in diamond configuration so long as they remain generally circumferential and cross most, if not all, of the radial strands and interlock rthese radial strands 25 and stitch threads 30 together.

What is claimed is:

1. A method of forming a patterned network fabric comprising the steps of:

(a) laying a plurality of base strands of thread in a base plane generally radially of and circumferentially spaced about a center position, and (b) stitching a plurality of individual, continuous, circumferential threads generally concentric with said center position and interlocking with said base strands.

2. The method according to claim 1 further comprising the step of laying adjacent base strands to form loops at their radial extremities.

3. The method according to claim 2 further comprising the steop of laying said base strands to extend diametrically through said center position.

4. The method according to claim 3 in which the step of laying said base strands comprises laying a single base thread continuously and alternating diametrically through said center position to form consecutively adjacent base strands having adjacent outer loops at the radial extremities of said base strands.

5. The method according to claim 4 further comprising the step of arranging a circumferential frame having a central opening and having projections on the perimeter of the frame surrounding said opening for receiving said loops as the laying of said base thread continues alternately back and forth across said central opening and through said center position, and removing said loops from said frame.

6. The method according to claim 5 in which said frame is made of detachable sections, said step of removing said loops comprising the detaching of at least one of said sections from the other sections.

* * * * *